US005107995A

United States Patent [19]

Simpson

[11] Patent Number: 5,107,995

[45] Date of Patent: Apr. 28, 1992

[54] STRAP FOR HOLDING A SURFBOARD

[76] Inventor: C. Robert Simpson, 1 Sand St., Laguna Niguel, Calif. 92677

[21] Appl. No.: 784,365

[22] Filed: Oct. 29, 1991

[51] Int. Cl.[5] ..... A47F 7/00

[52] U.S. Cl. ..... 211/60.1; 211/87; 224/917; 248/309.1

[58] Field of Search ..... 211/60.1, 89, 13, 87; 248/309.1; 224/226, 917

[56] References Cited

U.S. PATENT DOCUMENTS 4,878,585 11/1989 Orestano ..... 248/309.1 X 5,014,955 5/1991 Thompson ..... 211/89 X 5,067,644 11/1991 Coleman ..... 224/917 X

*Primary Examiner*—Robert W. Gibson, Jr.

*Attorney, Agent, or Firm*—Edgar W. Averill, Jr.

[57] ABSTRACT

A strap holding a surfboard or other elongated object. The strap has a pocket at its lower end and extends upwardly along the bottom of the surfboard. The strap has an opening which surrounds a fin of the surfboard and an eye at its upper end which is hooked over a hook on a wall. The strap then securely holds the surfboard against the wall for storage.

3 Claims, 1 Drawing Sheet

26
24
25
10
13
11
16
17
18
23
14
22
21
12
20
15

STRAP FOR HOLDING A SURFBOARD

BACKGROUND OF THE INVENTION

The field of the invention is racks and supports, and the invention relates more particularly to straps for supporting elongated objects such as a surfboard or windsurfer.

Most racks support elongated objects in a horizontal position such as that shown in U.S. Pat. No. 5,027,960. Unfortunately, in most rooms there is not sufficient space along a wall to support elongated objects such as a surfboard. Most walls are decorated with pictures, plants or other decorative objects which would not permit the horizontal mounting of a surfboard.

SUMMARY OF THE INVENTION

It is an object of the present invention to provide a device for vertically supporting a surfboard or other elongated object against a wall.

The present invention is for a strap holding a surfboard or other elongated object comprising a surfboard or other elongated object having a nose, a tail, a top surface, a bottom surface and at least one protrusion such as a fin extending outwardly from one of its surfaces. The elongated strap has a lower end which is affixed to a pocket which holds the nose of the surfboard or other object. The elongated strap extends upwardly from the pocket and has an opening which surrounds at least one fin or other protrusion and extends further upwardly to a hook or eye portion. Preferably, there is a swivel between the upper end of the strap and the eye.

DESCRIPTION OF THE PREFERRED EMBODIMENTS

Figures 1, 2, 3:
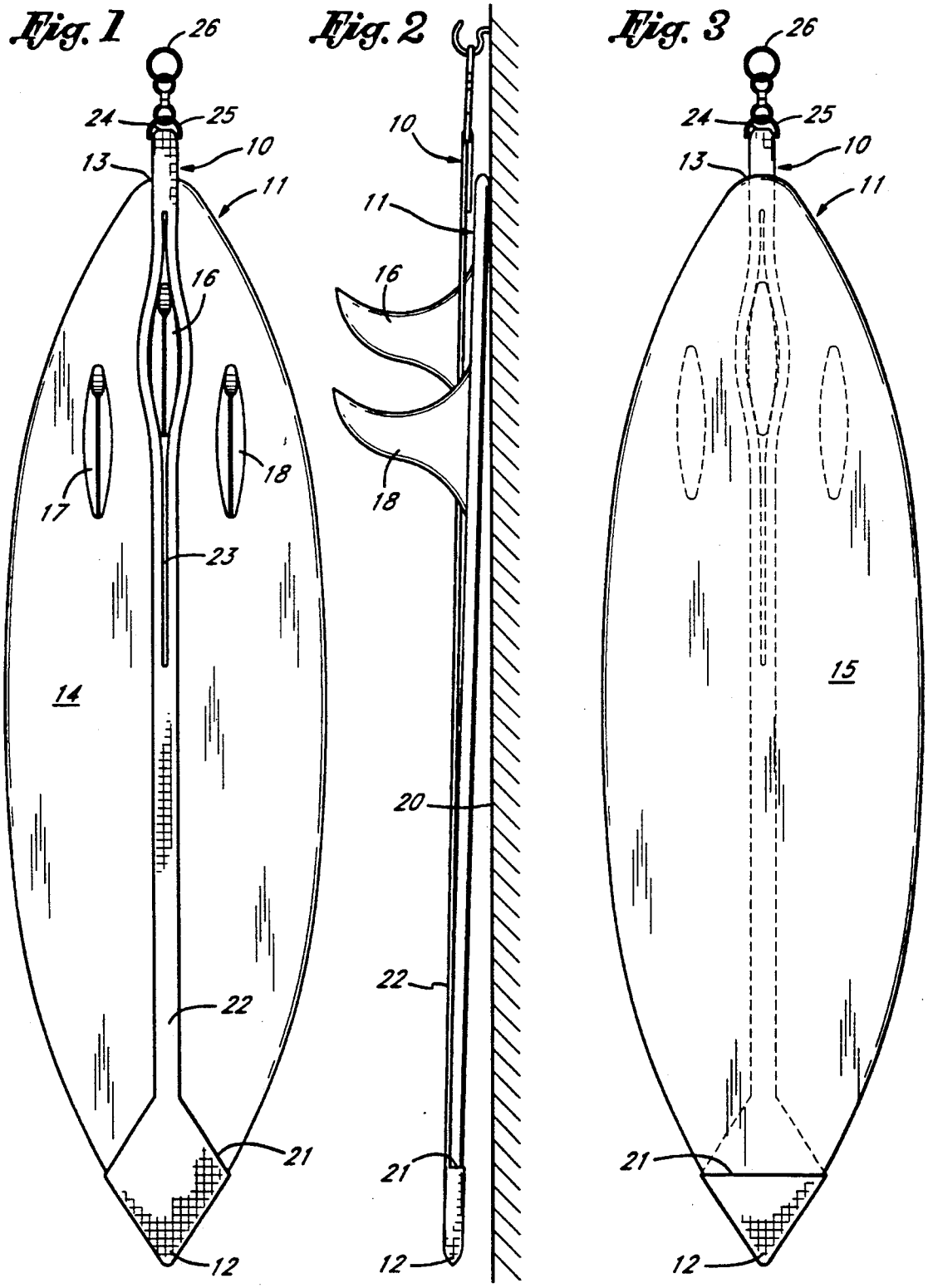
FIG. 1 is a front view of the strap holding a surfboard.
FIG. 2 is a side view thereof, also showing the wall to which the device is affixed.
FIG. 3 is a back view thereof.

The strap of the present invention is shown on a surfboard in FIG. 1, and the strap is indicated generally by reference character 10 and the surfboard generally by reference character 11. Surfboard 11 has a nose (hidden by the strap but its location being indicated by reference character 12), a tail 13, a bottom surface 14 and a top surface 15. Surfboard 11 also has a center fin 16 and two outboard fins 17 and 18.

Surfboard 11 is supported against a wall 20, shown in FIG. 2, by strap 10. Strap 10 has a lower pocket 21 which supports the nose of surfboard 11. An elongated strap 22 extends upwardly from pocket 21 and includes a slit 23 which surrounds center fin 16. The upper end 24 of strap 22 is looped over an eye 25 which is preferably connected to a second eye 26 through a swivel 27. As shown best in FIG. 2, the strap is balanced so that it securely holds the surfboard against wall 20. The weight of the board is supported by the pouch, and the slit 23 keeps the board in an upright position, and the wall 20 supports the tail of the board. Thus the weight of the board tends to hold the strap 22 under tension which, in turn, prevents the board from moving outwardly from the wall.

A nylon strap about 2" wide works very well although a pair of straps in place of the single strap 22 would also provide the needed slit. While a complete pocket is shown in the drawings, the pocket can, of course, be provided by a simple loop at the bottom of strap 22.

To remove the board, the board is simply turned 90° and the fin removed from slit 23 after which the board can be easily lifted out of the pocket 21.

While the present device has been discussed in connection with a surfboard, of course other elongated objects can be supported as well. In the specific instance of a surfboard, the pocket portion should be about 6" wide at its widest point, and the strap portion would extend approximately 34" from the top of the pocket. From that point, the buttonhole, or slit, should be about 3' long and then the strap would be joined and continued about 6" below the eye at the top. This would provide a strap assembly of about 88" long which could easily be supported along the typical 8' wall common to most residences.

The present embodiments of this invention are thus to be considered in all respects as illustrative and not restrictive; the scope of the invention being indicated by the appended claims rather than by the foregoing description. All changes which come within the meaning and range of equivalency of the claims are intended to be embraced therein.

What is claimed is:

1. A strap holding a surfboard or other elongated object comprising:

a surfboard having a nose, a stern, a tail, a top surface, a bottom surface and at least one fin extending outwardly from the bottom surface;

elongated strap means having a lower end and an upper end having a pocket affixed to said strap at its lower end which surrounds at least a portion of said nose of said surfboard, said elongated strap means having an elongated strap extending upwardly along said surfboard, and said elongated strap having an opening which surrounds said at least one fin, and said strap means extending upwardly past said tail; and eye means affixed to the upper end of said elongated strap.

2. The strap of claim 1 further including a swivel between the upper end of said elongated strap and said eye means.

3. The strap of claim 1 wherein said elongated strap is a single length of webbing including an elongated slit along the midpoint thereof.

* * * * *